US005638339A

United States Patent [19]

DeLoretto et al.

[11] Patent Number: 5,638,339

[45] Date of Patent: Jun. 10, 1997

[54] BATHROOM CLOCK AND LIGHT

[76] Inventors: John N. DeLoretto; Denise L. P. DeLoretto, both of 412 Lore Ave., Wilmington, Del. 19809

[21] Appl. No.: 617,548

[22] Filed: Mar. 19, 1996

[51] Int. Cl.[6] ..... G04B 47/00; H01R 33/00; F21V 33/00

[52] U.S. Cl. ..... 368/10; 362/226; 362/253; D26/26; D26/54

[58] Field of Search ..... 368/10, 12, 67, 368/278, 316–317; 362/253, 226; D26/26, 51, 54

[56] References Cited

U.S. PATENT DOCUMENTS

| | | | |
|---|---|---|---|
| 1,943,598 | 1/1934 | Gourley | 368/10 |
| 4,253,170 | 2/1981 | Meisner | 368/67 |
| 4,285,028 | 8/1981 | Sundin et al. | 362/35 |
| 4,816,973 | 3/1989 | Atalla et al. | 368/226 |
| 4,949,077 | 8/1990 | Misuthia | 340/628 |
| 5,318,177 | 6/1994 | Isalson | 206/38.1 |
| 5,465,198 | 11/1995 | Kellogg | 362/253 |
| 5,469,346 | 11/1995 | Haut et al. | 362/205 |
| 5,524,101 | 6/1996 | Thorgersen | 368/10 |

*Primary Examiner*—Vit W. Miska

[57] ABSTRACT

A bathroom clock and light including a light housing having a front portion, a rear portion, and a central portion therebetween. The front portion has an upper light secured within an upper end thereof. The rear portion has a pair of electrical prongs extending outwardly therefrom. The electrical prongs have wiring coupling with the upper light. The central portion has a hollow chamber formed therein. An upper end of the central portion has a securement portion secured thereto. A time and date indicating portion is rotatably coupled with the securement portion of the light housing. The display center serves to indicate time of day and date of day.

4 Claims, 3 Drawing Sheets

BATHROOM CLOCK AND LIGHT

BACKGROUND OF THE INVENTION

1. Field of the Invention

The present invention relates to a bathroom clock and light and more particularly pertains to indicating time of day and date and providing illumination with a bathroom clock and light.

2. Description of the Prior Art

The use of clock systems is known in the prior art. More specifically, clock systems heretofore devised and utilized for the purpose of providing time and other features are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,321,669 to Thayer et al. discloses an aromatic alarm clock system.

U.S. Pat. No. 5,199,009 to Svast discloses a reminder clock.

U.S. Pat. No. Des. 326,726 to Swain, Jr. discloses the ornamental design for a combined night light and alarm clock.

U.S. Pat. No. Des. 308,829 to Gaultier et al. discloses the ornamental design for a digital clock.

U.S. Pat. No. Des. 318,806 to Williams discloses a digital clock.

U.S. Pat. No. 5,303,211 to Yanaka et al. discloses a wall clock.

While these devices fulfill their respective, particular objective and requirements, the aforementioned patents do not describe a bathroom clock and light for indicating time of day and date and providing illumination.

In this respect, the bathroom clock and light according to the present invention substantially departs from the conventional concepts and designs of the prior art, and in doing so provides an apparatus primarily developed for the purpose of indicating time of day and date and providing illumination.

Therefore, it can be appreciated that there exists a continuing need for new and improved bathroom clock and light which can be used for indicating time of day and date and providing illumination. In this regard, the present invention substantially fulfills this need.

SUMMARY OF THE INVENTION

In the view of the foregoing disadvantages inherent in the known types of clock systems now present in the prior art, the present invention provides an improved bathroom clock and light. As such, the general purpose of the present invention, which will be described subsequently in greater detail, is to provide a new and improved bathroom clock and light and method which has all the advantages of the prior art and none of the disadvantages.

To attain this, the present invention essentially comprises a light housing comprised of a generally rectangular configuration. The light housing has a front portion, a rear portion, and a central portion therebetween. The front portion has an upper light secured within an upper end thereof. The front portion has an illumination light secured within an intermediate portion thereof. The front portion has a clear cover secured thereto disposed over the illumination light. The rear portion has a pair of electrical prongs extending outwardly therefrom. The electrical prongs have wiring coupling with the upper light and the illumination light. The central portion has a hollow chamber formed therein. An upper end of the central portion has a securement portion secured thereto. The device includes a time and date indicating portion comprising a generally rectangular-shaped display center. The display center has a shaft portion pivotally coupled with a rear portion thereof. A distal end of the shaft portion is rotatably coupled with the securement portion of the light housing. The display center has means for indicating time of day and date of day.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bathroom clock and light which has all the advantages of the prior art clock systems and none of the disadvantages.

It is another object of the present invention to provide a new and improved bathroom clock and light which may be easily and efficiently manufactured and marketed.

It is a further object of the present invention to provide a new and improved bathroom clock and light which is of durable and reliable construction.

An even further object of the present invention is to provide a new and improved bathroom clock and light which is susceptible of a low cost of manufacture with regard to both materials and labor, and which accordingly is then susceptible of low prices of sale to the consuming public, thereby making such a bathroom clock and light economically available to the buying public.

Still yet another object of the present invention is to provide a new and improved bathroom clock and light which provides in the apparatuses and methods of the prior art some of the advantages thereof, while simultaneously overcoming some of the disadvantages normally associated therewith.

Even still another object of the present invention is to provide a new and improved bathroom clock and light for indicating time of day and date and providing illumination.

Lastly, it is an object of the present invention to provide a new and improved bathroom clock and light including a light housing having a front portion, a rear portion, and a central portion therebetween. The front portion has an upper light secured within an upper end thereof. The rear portion has a pair of electrical prongs extending outwardly therefrom. The electrical prongs have wiring coupling with the upper light. The central portion has a hollow chamber formed therein. An upper end of the central portion has a securement portion secured thereto. A time and date indicating portion is rotatably coupled with the securement portion of the light housing. The display center serves to indicate time of day and date of day.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various FIGS.

DESCRIPTION OF THE PREFERRED EMBODIMENT

Figure 1:
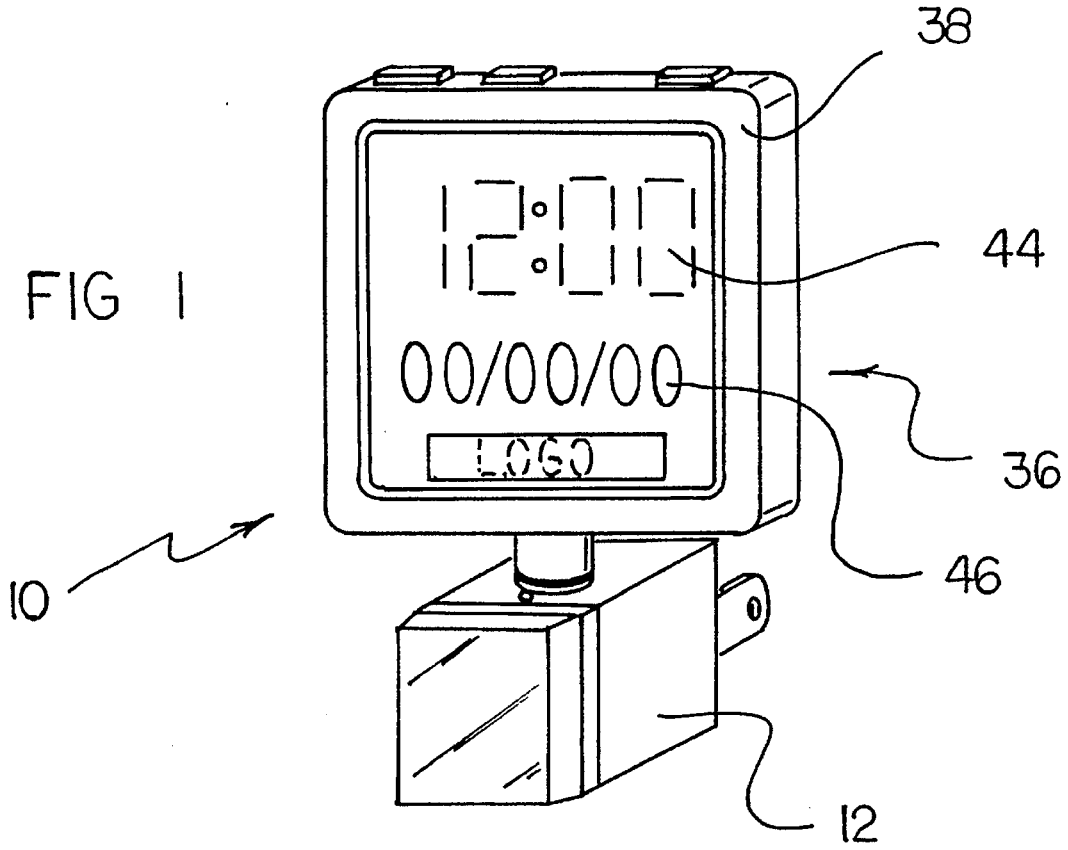
FIG. 1 is a perspective view of the preferred embodiment of the bathroom clock and light constructed in accordance with the principles of the present invention.
Figure 2:
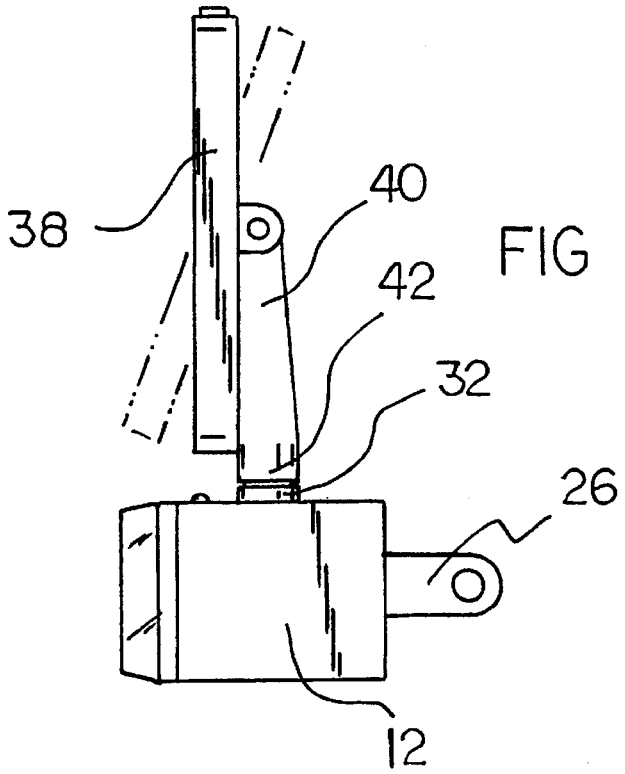
FIG. 2 is a side elevation view of the present invention.
Figure 3:
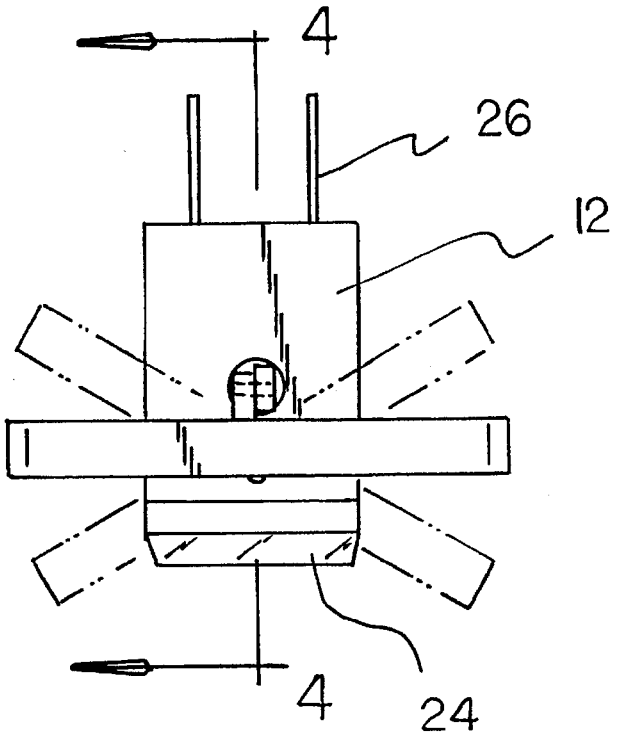
FIG. 3 is a plan view of the preferred embodiment of the present invention.
Figure 4:
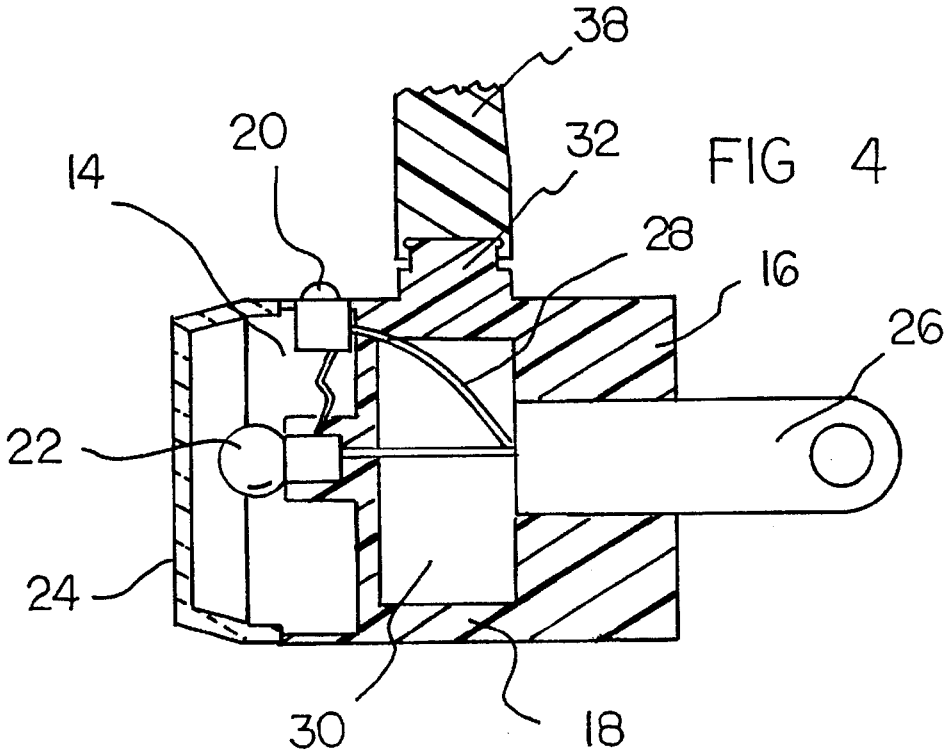
FIG. 4 is a cross-sectional view as taken along line 4—4 of FIG. 3.

With reference now to the drawings, and in particular, to FIGS. 1–4 thereof, the preferred embodiment of the new and improved bathroom clock and light embodying the principles and concepts of the present invention and generally designated by the reference number 10 will be described.

Specifically, it will be noted in the various Figures that the device relates to a new and improved bathroom clock and light for indicating time of day and date and providing illumination. In its broadest context, the device consists of a light housing and a time and date indicating portion. Such components are individually configured and correlated with respect to each other so as to attain the desired objective.

The device 10 includes a light housing 12 comprised of a generally rectangular configuration. The light housing 12 has a front portion 14, a rear portion 16, and a central portion 18 therebetween. The front portion 14 has an upper light 20 secured within an upper end thereof. The front portion 14 has an illumination light 22 secured within an intermediate portion thereof. The front portion 14 has a clear cover 24 secured thereto disposed over the illumination light 22. The clear cover 24 can be removed to readily change the upper light 20 and the illumination light 22. The rear portion 16 has a pair of electrical prongs 26 extending outwardly therefrom. The pair of electrical prongs 26 are adapted to be plugged into an electrical outlet to power the upper light 20 and the illumination light 22. The electrical prongs 26 have wiring 28 coupling with the upper light 20 and the illumination light 22. The central portion 18 has a hollow chamber 30 formed therein. An upper end of the central portion 18 has a securement portion 32 secured thereto.

The device 10 includes a time and date indicating portion 36 comprising a generally rectangular-shaped display center 38. The display center 38 could be made in any number of design variations. The display center 38 has a shaft portion 40 pivotally coupled with a rear portion thereof. A distal end 42 of the shaft portion 40 is rotatably coupled with the securement portion 32 of the light housing 12. The display center 38 has means for indicating time of day and date of day. The display center 38 has a front panel that will show the time of day 44 and the date of the particular day 46. The display center 38 has a place on a lower end thereof for a logo or company name to be placed. The display center 38 has control buttons 48 on its upper end to set the time of day 44 and the date of the day 46. The display center 38 is electrically coupled with the electric prongs 26 of the light housing 12 to power the time of day 44. The display center 44 illuminates in an manner similar to laptop computers as well as alpha-numeric pagers.

Figure 5:
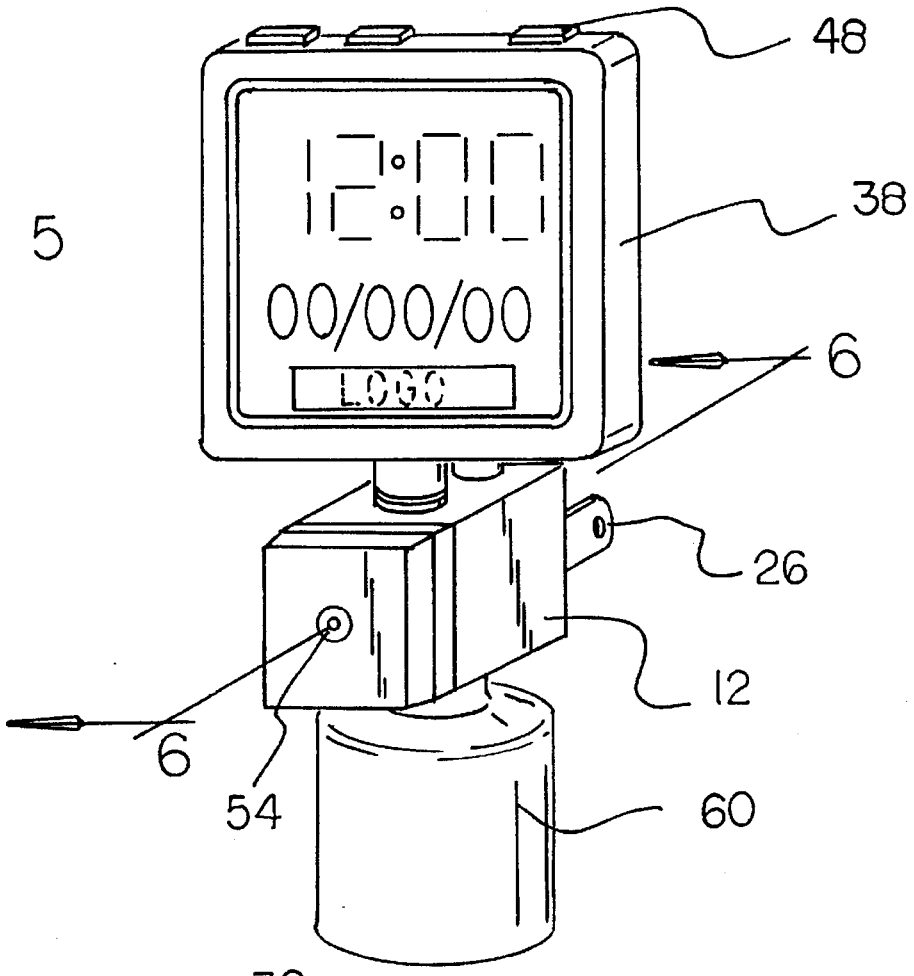
FIG. 5 is a perspective view of a second embodiment of the present invention.
Figure 6:
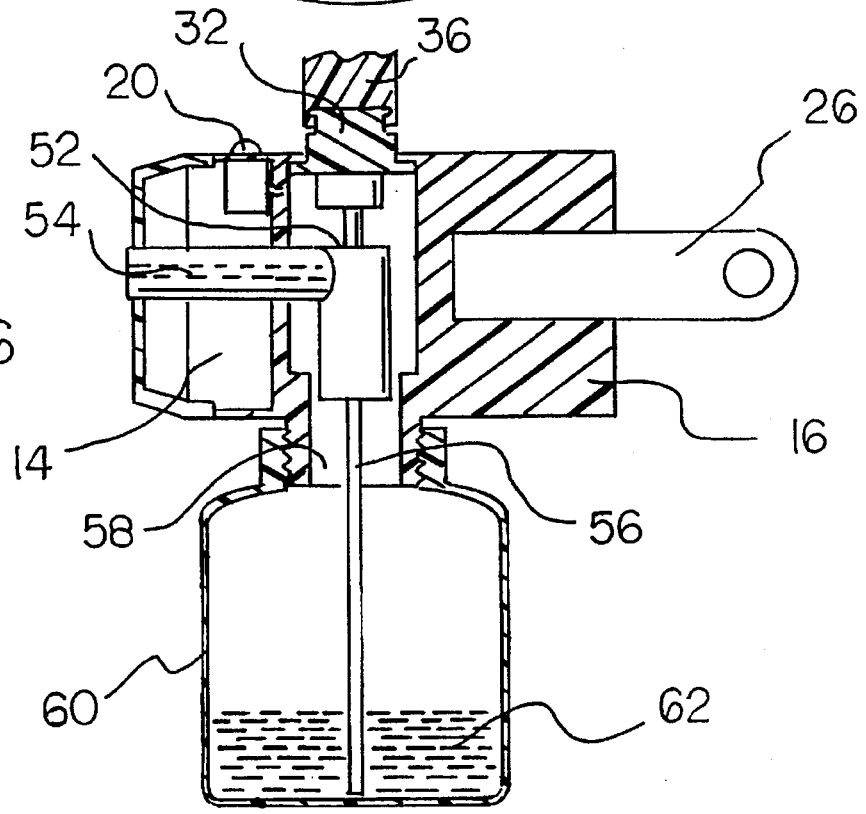
FIG. 6 is a cross-sectional view as taken along line 6—6 of FIG. 5.

A second embodiment of the present invention is shown in FIGS. 5 and 6 and includes substantially all of the components of the present invention wherein the securement portion 32 of the light housing 12 is slidably coupled within the upper end of the central portion 18 thereof. A lower end of the securement portion 32 has a pump mechanism 52 secured thereto. The pump mechanism 52 has a spray portion 54 extending outwardly of the front portion 14 of the light housing 12. A shaft portion 56 of the pump mechanism 52 extends outwardly of an open lower end 58 of the central portion 18. The open lower end 58 of the central portion 18 has a perfume container 60 secured thereto. A user will simply press down on the display center 38 causing the securement portion 32 to slide within the central portion 18 of the light housing 12 thus causing the pump mechanism 52 to draw perfume 62 up through the shaft portion 56 to be sprayed outwardly of the spray portion 54. The perfume container 60 can be easily removed from the light housing 12 to allow a user to refill the container 60 once it is empty.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A bathroom clock and light for indicating time of day and date and providing illumination comprising, in combination:

a light housing comprised of a generally rectangular configuration, the light housing having a front portion, a rear portion, and a central portion therebetween, the front portion having an upper light secured within an upper end thereof, the front portion having an illumination light secured within an intermediate portion thereof, the front portion having a clear cover secured thereto disposed over the illumination light, the rear portion having a pair of electrical prongs extending outwardly therefrom, the electrical prongs having wiring coupling with the upper light and the illumination light, the central portion having a hollow chamber formed therein, an upper end of the central portion having a securement portion secured thereto;

a time and date indicating portion comprising a generally rectangular-shaped display center, the display center having a shaft portion pivotally coupled with a rear portion thereof, a distal end of the shaft portion rotatably coupled with the securement portion of the light housing, the display center having means for indicating time of day and date of day.

2. A bathroom clock and light for indicating time of day and date and providing illumination comprising, in combination:

a light housing having means for coupling with an electrical outlet;

a time and date indicating portion rotatably coupled with the light housing and having means for indicating time of day and date of day; and a perfume sprayer disposed within the light housing and in communication with the time and date indicating portion.

3. The bathroom clock and light as set forth in claim 2 wherein the light housing having a front portion, a rear portion, and a central portion therebetween, the front portion having an upper light secured within an upper end thereof, the rear portion having a pair of electrical prongs extending outwardly therefrom, the electrical prongs having wiring coupling with the upper light, the central portion having a hollow chamber formed therein, an upper end of the central portion having a securement portion secured thereto.

4. The bathroom clock and light as set forth in claim 3 wherein the securement portion of the light housing is slidably coupled within the upper end of the central portion thereof, a lower end of the securement portion having a pump mechanism secured thereto, the pump mechanism having a spray portion extending outwardly of the front portion of the light housing, a shaft portion of the pump mechanism extending outwardly of an open lower end of the central portion, the open lower end of the central portion having a perfume container secured thereto.

* * * * *